US009190776B2

(12) United States Patent
Lee et al.

(10) Patent No.: US 9,190,776 B2
(45) Date of Patent: Nov. 17, 2015

(54) QUICK LOCK CONNECTOR ASSEMBLY

(71) Applicant: Advanced-Connectek Inc., New Taipei (TW)

(72) Inventors: Kuo-Ching Lee, New Taipei (TW); Conrad Yee Yang Choy, New Taipei (TW); Jian-Li Guan, Tian-Jin (CN); Ya-Ping Liang, New Taipei (TW); Ta-Teh Meng, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 14/256,238

(22) Filed: Apr. 18, 2014

(65) Prior Publication Data

US 2014/0322941 A1 Oct. 30, 2014

(30) Foreign Application Priority Data

Apr. 25, 2013 (CN) ..... 2013 1 0145792

(51) Int. Cl.
*H01R 12/24* (2006.01)
*H01R 13/639* (2006.01)
*H01R 12/88* (2011.01)

(52) U.S. Cl.
CPC ..... *H01R 13/639* (2013.01); *H01R 12/88* (2013.01)

(58) Field of Classification Search
CPC ..... H01R 23/725; H01R 13/62933; H01R 13/629; H01R 23/622; H01R 23/6873; H01R 13/658; H01R 23/7073
USPC ..... 439/74, 372, 376, 497, 607.35, 607.4, 439/607.41, 607.49, 660
See application file for complete search history.

(56) References Cited

U.S. PATENT DOCUMENTS

| | | | | |
|---|---|---|---|---|
| 7,094,092 | B2 * | 8/2006 | Yang | 439/495 |
| 7,927,122 | B2 * | 4/2011 | Yamaji et al. | 439/342 |
| 8,241,065 | B2 * | 8/2012 | Ikari et al. | 439/607.41 |
| 8,388,370 | B2 * | 3/2013 | Yamaji et al. | 439/497 |
| 8,550,849 | B2 * | 10/2013 | Yamaji | 439/607.41 |
| 8,647,141 | B2 * | 2/2014 | Lee et al. | 439/372 |
| 8,727,803 | B2 * | 5/2014 | Kurachi | 439/497 |

* cited by examiner

*Primary Examiner* — Thanh Tam Le
(74) *Attorney, Agent, or Firm* — patenttm.us

(57) ABSTRACT

A quick lock connector assembly has a female connector and a male connector. The female connector has a first insulative housing, multiple first terminals, an outer casing and a locking lever. The locking lever is mounted pivotally on the outer casing and has two locking pins. The male connector is engaged detachably with the female connector and has a second insulative housing and multiple second terminals. The second insulative housing has two locking recesses selectively engaged respectively with the locking pins. The locking lever is able to quickly lock the male connector on the female connector.

9 Claims, 9 Drawing Sheets

QUICK LOCK CONNECTOR ASSEMBLY

BACKGROUND OF THE INVENTION

1. Field of the Invention

The present invention relates to a connector, and more particularly to a quick lock connector assembly that has a female connector and a male connector. The female connector is capable of additionally locking the male connector to prevent inadvertent separation of the female connector from the male connector.

2. Description of Related Art

Board-to-board connectors are common components employed in electronic devices and are used to connect mother boards and expansion boards so that the motherboards can acquire additional functions and facilitate maintenance and replacement of the expansion boards.

Conventional board-to-board connectors are set into pairs such as a male connector and a female connector matching the male connector. The male and female connectors are mounted respectively on different printed circuit boards (PCBs) and are detachably engaged with each other.

However, after repetitive plugs and pulls of the male and female connectors, material fatigue and deformation happen to cause engagement of the male and female connectors to be loosened and weakened. The male connector easily separates from the female connector. Furthermore, no locking mechanism is implemented between the male and female connectors so that inadvertently pulling the motherboard on which the male or female connector is mounted may separate the male and female connectors.

To overcome the shortcomings, the present invention provides a quick lock connector assembly to mitigate or obviate the aforementioned problems.

SUMMARY OF THE INVENTION

The main objective of the invention is to provide a quick lock connector assembly that has a female connector and a male connector. The female connector is capable of additionally locking the male connector to prevent inadvertent separation of the female connector from the male connector.

A quick lock connector assembly in accordance with the present invention has a female connector and a male connector. The female connector has a first insulative housing, multiple first terminals, an outer casing and a locking lever. The locking lever is mounted pivotally on the outer casing and has two locking pins. The male connector is engaged detachably with the female connector and has a second insulative housing and multiple second terminals. The second insulative housing has two locking recesses selectively engaged respectively with the locking pins. The locking lever is able to quickly lock the male connector on the female connector.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
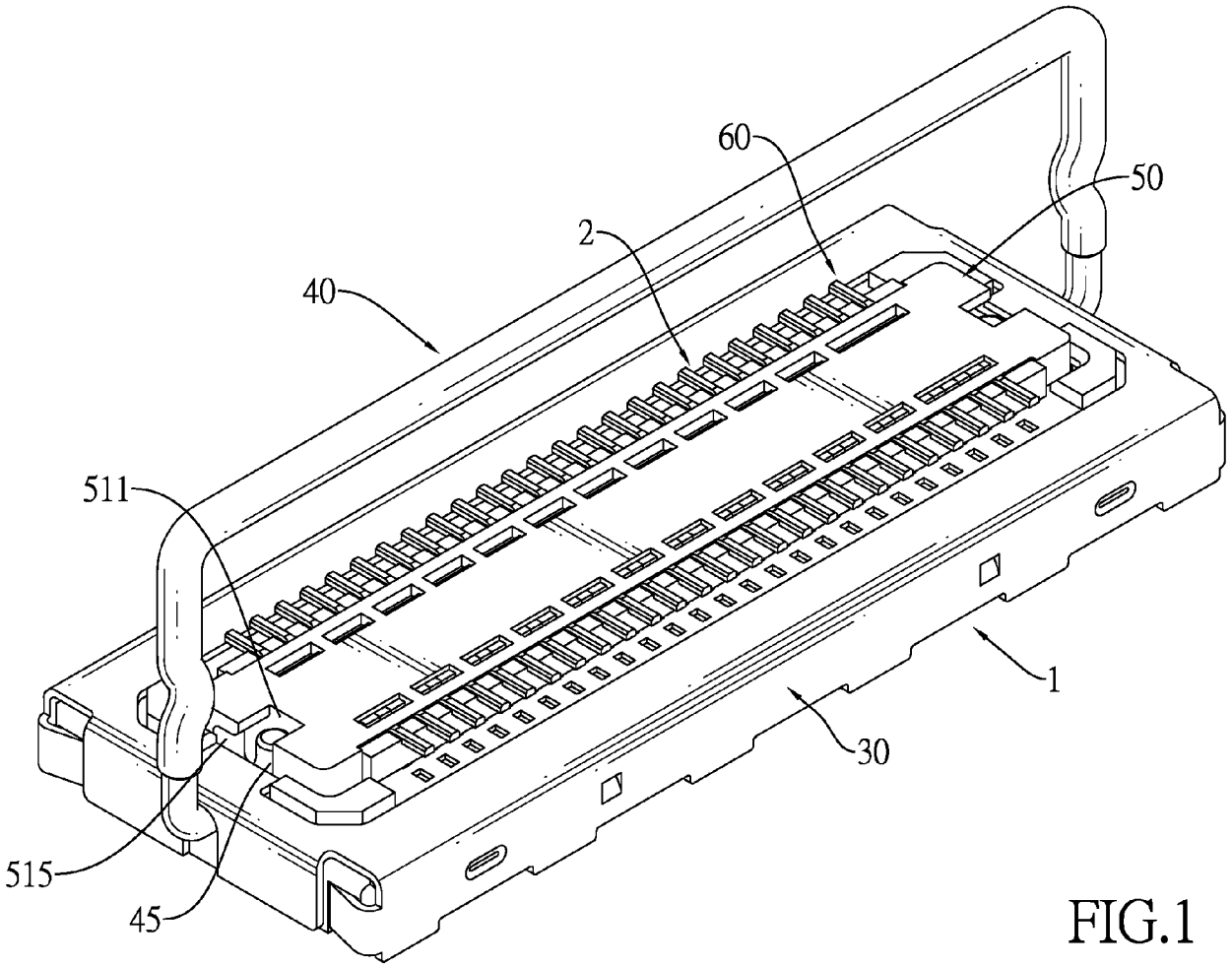
FIG. 1 is a perspective view of a quick lock connector assembly in accordance with the present invention.
Figure 2:
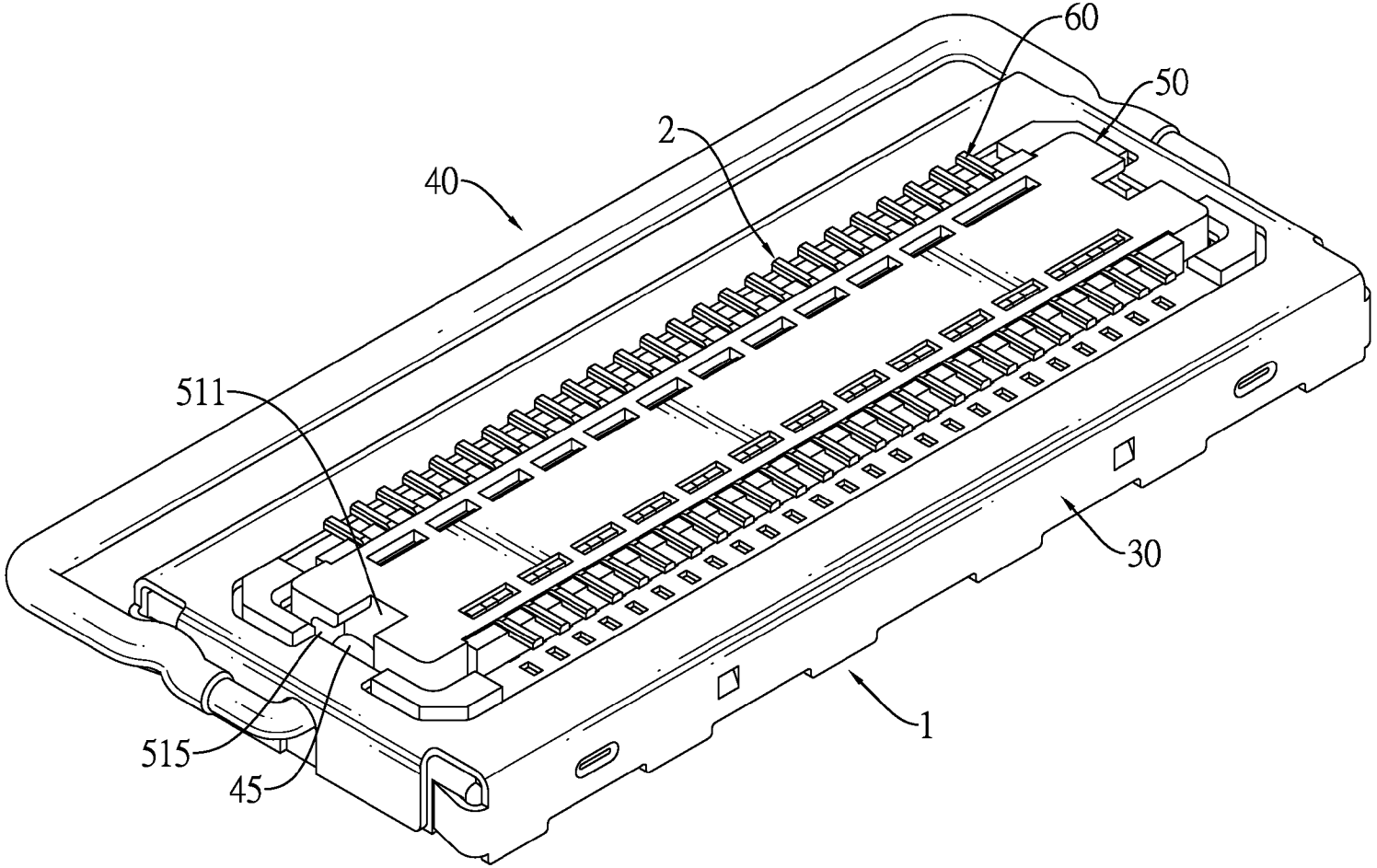
FIG. 2 is an operational perspective view of the quick lock connector assembly in FIG. 1 with the locking lever pivoted down to clip and lock the male connector on the female connector.
Figure 3:
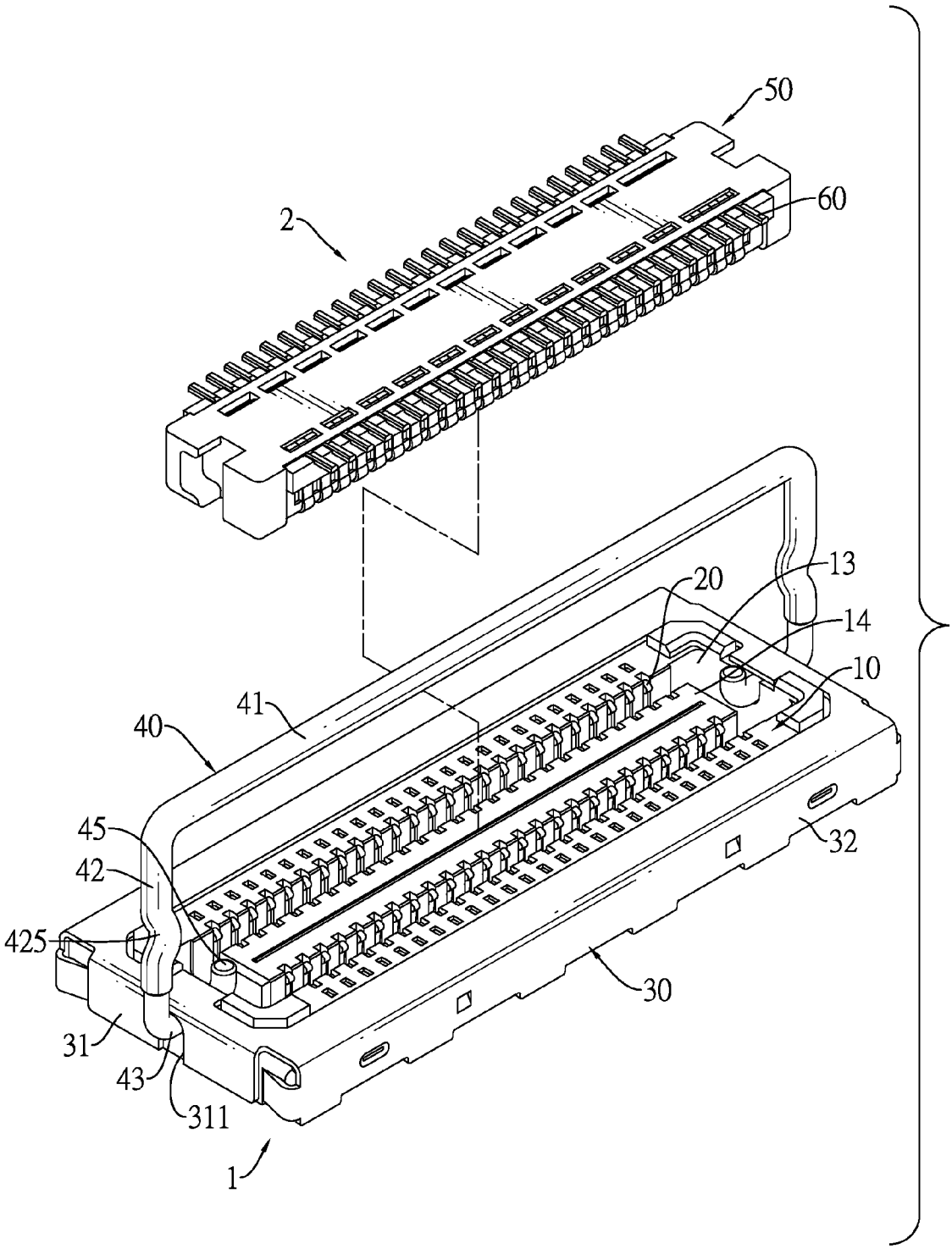
FIG. 3 is an exploded perspective view of the quick lock connector assembly in FIG. 1 with the male connector separating from the female connector.

With reference to FIGS. 1 to 3, a quick lock connector assembly in accordance with the present invention comprises a female connector 1 and a male connector 2.

Figure 4:
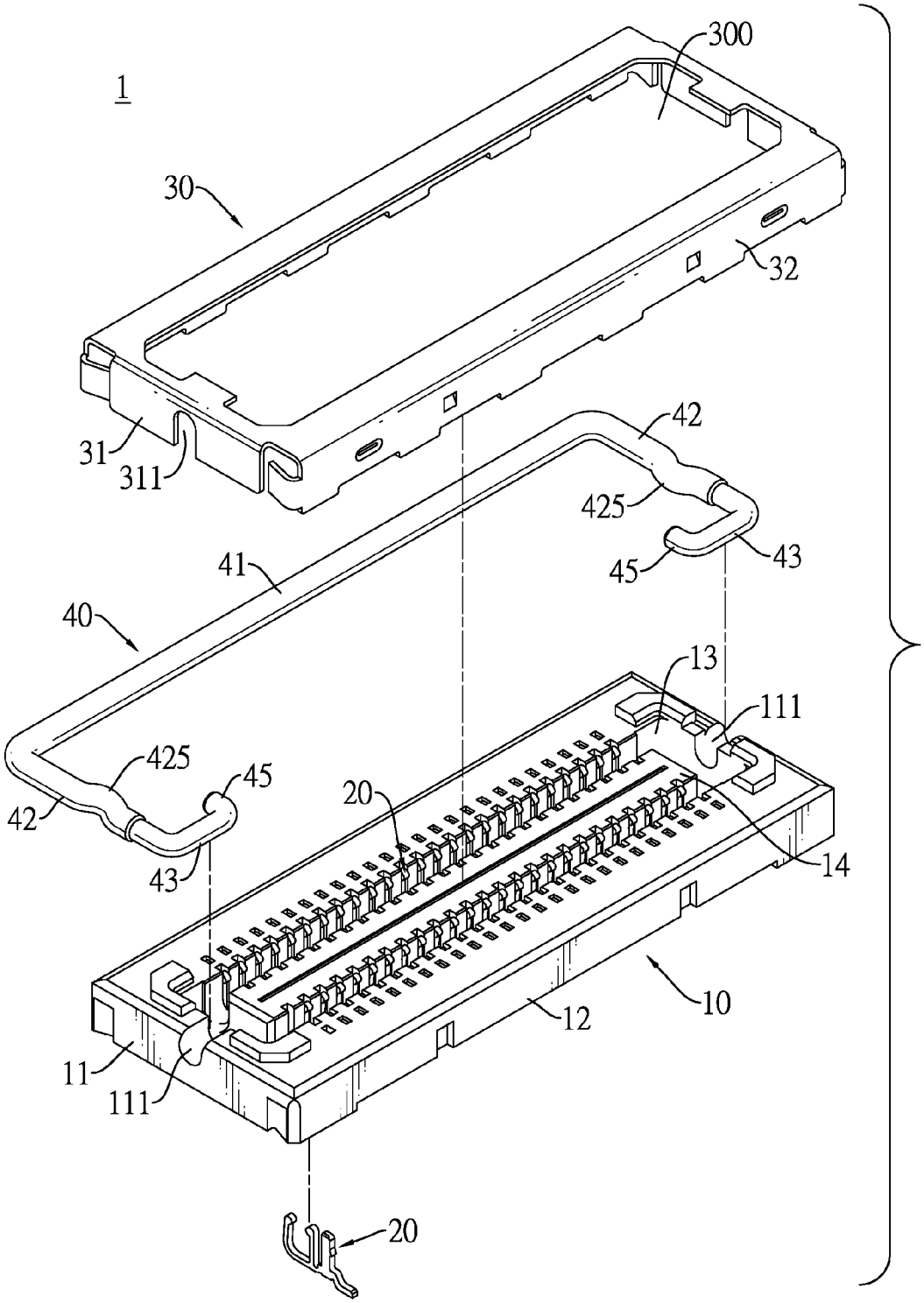
FIG. 4 is an exploded perspective view of a female connector of the quick lock connector assembly in FIG. 3.

With further reference to FIG. 4, the female connector 1 may be mounted on a printed circuit board (PCB) such as a motherboard and has a first insulative housing 10, multiple first terminals 20, an outer casing 30 and a locking lever 40.

The first insulative housing 10 may be made of plastic and has two opposite first edges 11, two opposite second edges 12, a socket hole 13, a spine 14 and two assembling holes 111.

The socket hole 13 is defined in a top of the first insulative housing 10.

The spine 14 is formed in and protrudes upward from the socket hole 13.

The assembling holes 111 are defined respectively in the first edges 11.

The first terminals 20 are mounted in the socket hole 13.

The outer casing 30 may be made of metal or other anti-wear material, is mounted on the first insulative housing 10, and has two opposite first sides 31, two opposite second sides 32, two pivot holes 311 and an opening 300.

The pivot holes 311 are defined respectively through the first sides 31 of the outer casing 30.

The opening 300 is defined through the outer casing 30 and corresponds to the socket hole 13 so that the socket hole 13 is exposed completely.

The locking lever 40 may be made of metal or other anti-wear material and is mounted pivotally through the first sides 31 of the outer casing 30, and is mounted pivotally through the first edges 11 of the first insulative housing 10. The locking lever 40 has an operating section 41, two positioning sections 42, two pivot sections 43 and two locking pins 45.

The positioning sections 42 are formed on and protrude respectively from two ends of the operating section 41 and selectively press respectively against the first sides 31 of the outer casing 30. Each positioning section 42 has a V-shaped and peak-like positioning element 425 formed on the pivot section 43 and selectively pressing against one of the first sides 31 of the outer casing 30.

The pivot sections 43 are formed on and protrude respectively from the positioning sections 42, rotatably extend respectively through the pivot holes 311 of the first sides 31 of the outer casing 30, and also rotatably extend respectively through the assembling holes 111 of the first edges 11 of the first insulative housing 10.

The locking pins 45 are formed on and protrude respectively from the pivot sections 43, may be substantially perpendicular to the pivot sections 43 and are located in the socket hole 13 of the first insulative housing 10.

Furthermore, the locking lever 40 may be resilient so that the positioning sections 42 slightly deform when pressing respectively against the first sides 31 of the outer casing 30.

Figure 5:
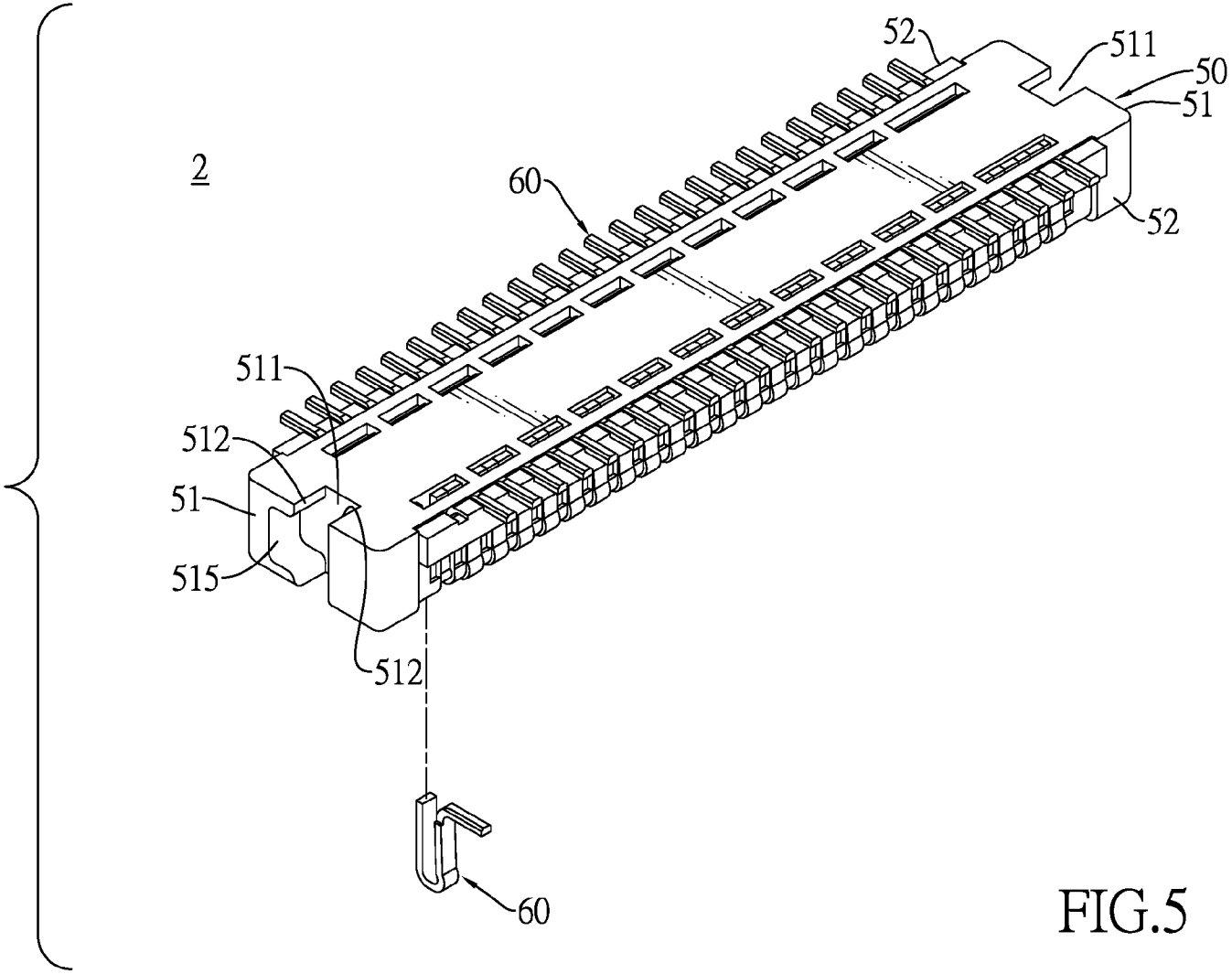
FIG. 5 is a partially exploded perspective view of the male connector of the quick lock connector assembly in FIG. 3.

With further reference FIG. 5, the male connector 2 may be mounted on another PCB such as an expansion card or a flexible PCB, is engaged detachably with the female connector 1 and has a second insulative housing 50 and multiple second terminals 60.

The second insulative housing 50 may be made of plastic, is mounted detachably in the socket hole 13 of the first insulative housing 10 and has two opposite first sidewalls 51, two opposite second sidewalls 52, two through slots 511 and two locking recesses 515.

The through slots 511 are vertically defined through the second insulative housing 50 and respectively in the first sidewalls 51, and each through slot 511 has two opposite inner walls 512.

The locking recesses 515 are defined respectively in the first sidewalls 51 of the second insulative housing 50, correspond to the through slots 511 and are selectively engaged respectively with the locking pins 45 of the locking lever 40. Each locking recess 515 may be defined in one of the inner walls 512 of a corresponding through slot 511.

Furthermore, the second insulative housing 50 may further have a mounting recess to receive the spine 14 of the first insulative housing 10.

The second terminals 60 are mounted in the second insulative housing 50 and selectively and respectively contact the first terminals 20.

Figure 6:
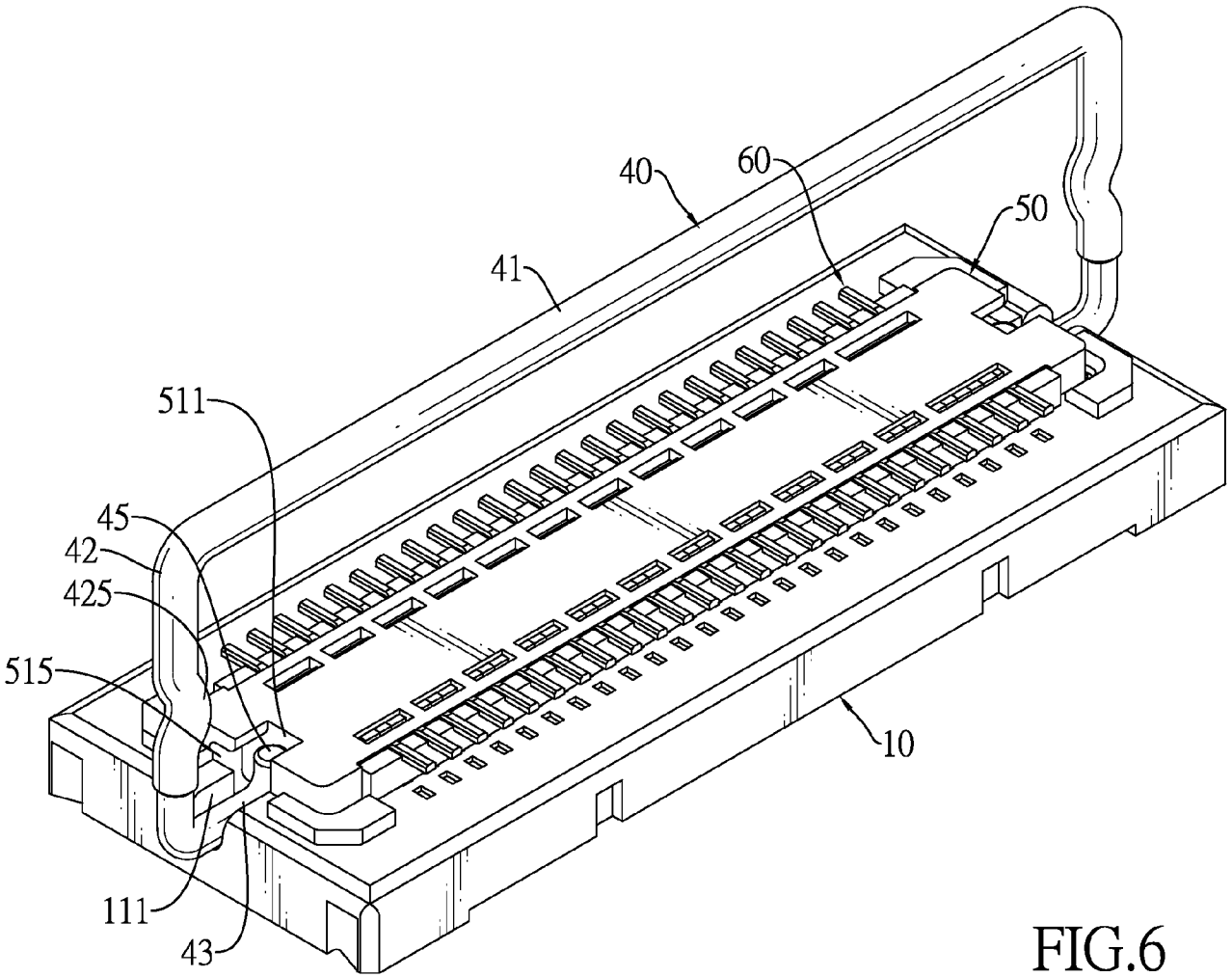
FIG. 6 is a perspective view of the quick lock connector assembly in FIG. 1 with the outer casing of the female connector omitted.
Figure 8:
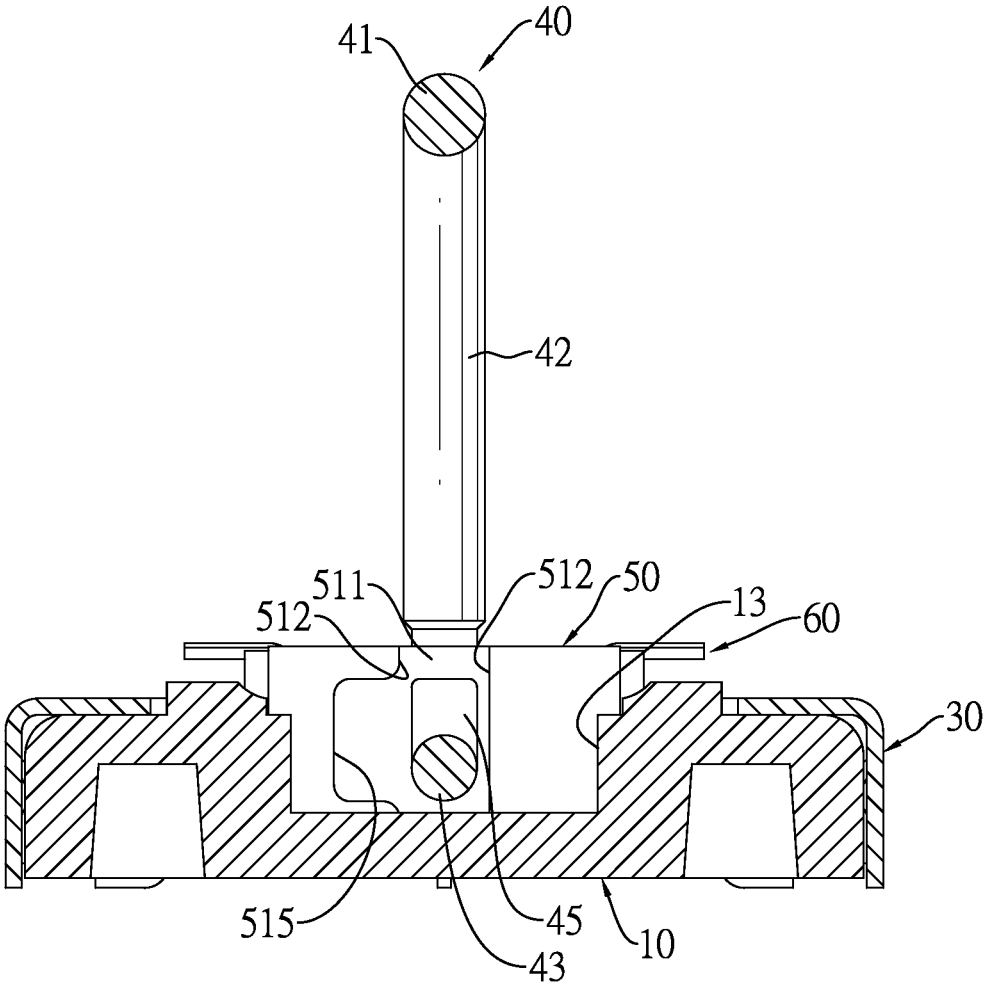
FIG. 8 is a cross sectional side view of the quick lock connector assembly in FIG. 1.

With further reference FIGS. 6 and 8, when the positioning sections 42 of the locking lever 40 pivot to separate respectively from the first sides 31 of the outer casing 30, the locking pins 45 disengage respectively from the locking recesses 515 and are respectively parallel with the through slots 511. In the meanwhile, the male connector 2 may be moved vertically, specifically pulled upward to disengage the second insulative housing 50 from the first insulative housing 10 so that the male connector 2 can be easily detached from the female connector 1.

Figure 7:
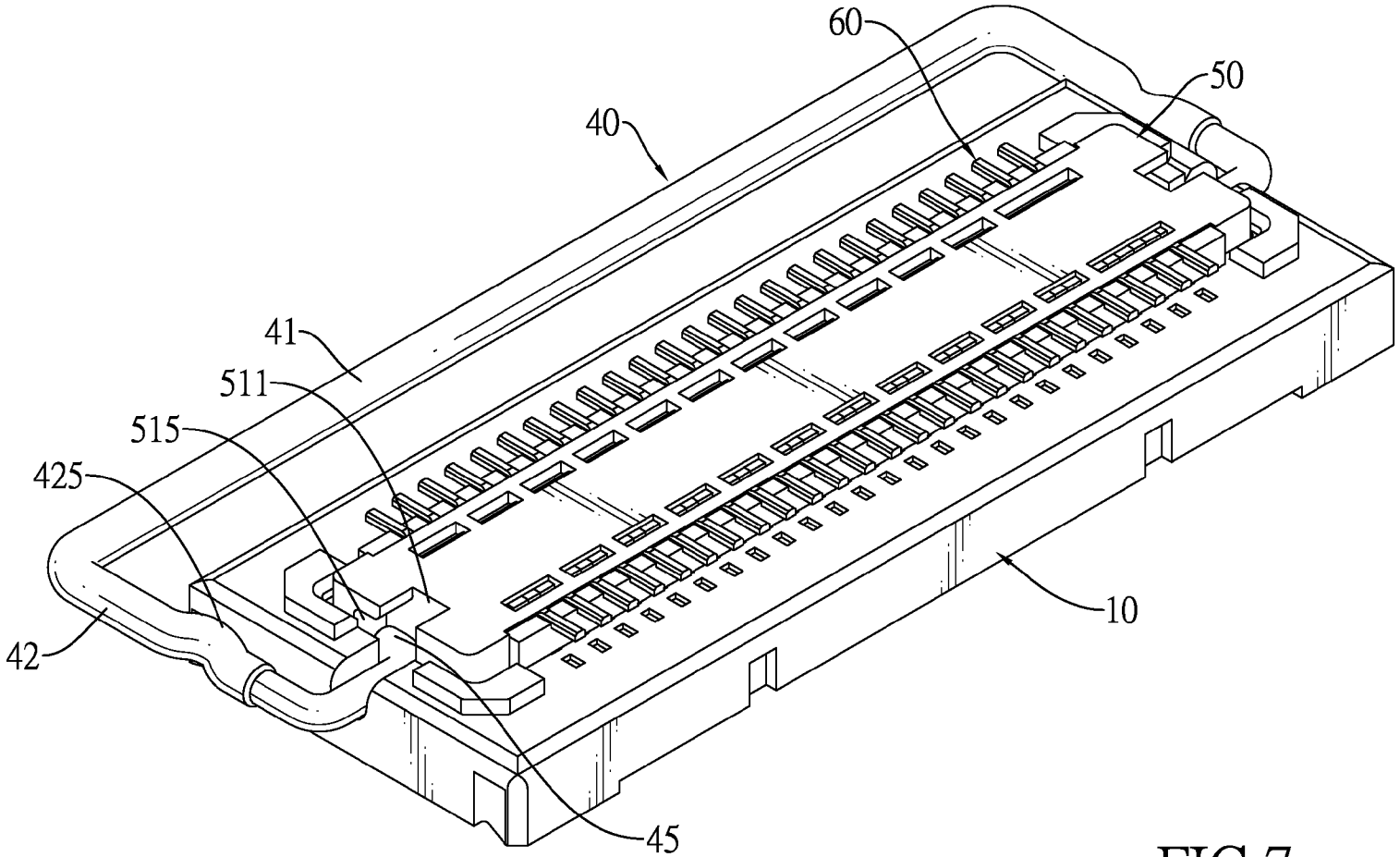
FIG. 7 is an operational perspective view of the quick lock connector assembly in FIG. 2 with the outer casing omitted.
Figure 9:
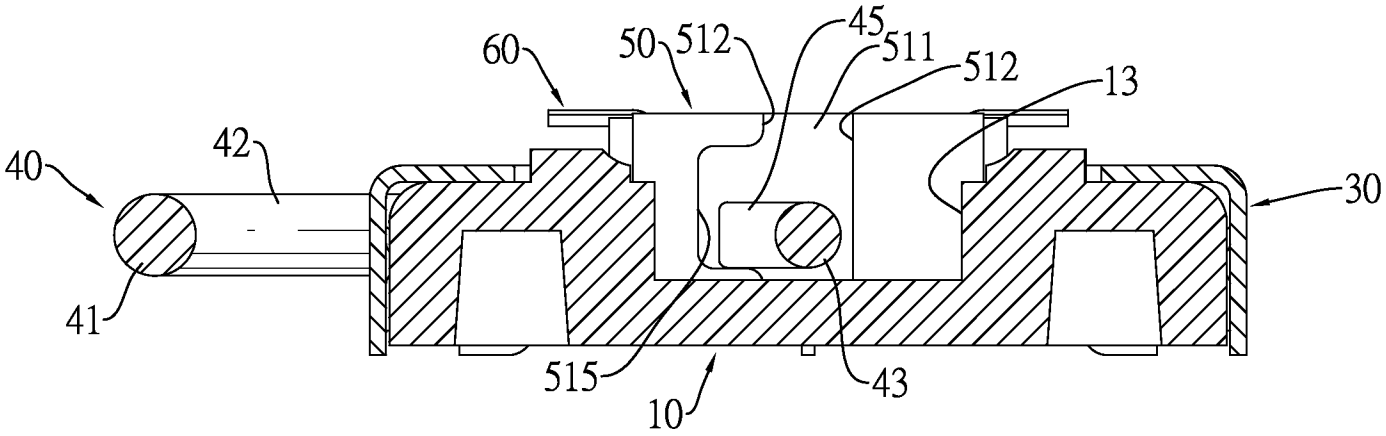
FIG. 9 is an operational cross sectional side view of the quick lock connector assembly in FIG. 2.

With further reference to FIGS. 7 and 9, when the positioning sections 42 of the locking lever 40 pivot to press respectively against the first sides 31 of the outer casing 30, the locking pins 45 are engaged respectively with the locking recesses 515 and are perpendicular respectively to the through slots 511 of the second insulative housing 50. In the meanwhile, the second insulative housing 50 is locked by the locking pins 45 and is incapable of disengaging from the socket hole 13 of the first insulative housing 10 so that the male connector 2 cannot be detached from the female connector 1. Therefore, inadvertent disengagement of the male connector 2 from the female connector 1 can be prevented.

The quick lock connector assembly has the following advantages.

1. Pivoting the locking lever 40 on the female connector 1 to engage the locking pins 45 with the locking recesses 515 allows the male connector 2 to be locked on the female connector 1 so as to prevent inadvertent disengagement of the male connector 2 from the female connector 1.

2. The outer casing 30 and the locking lever 40 made of metal or other anti-wear material not only increase the structural strength thereof, improve the locking ability and durability, but also prevent the locking lever 40 from directly contacting and wearing the plastic-made first insulative housing 10 or second insulative housing 50.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A quick lock connector assembly comprising:

a female connector having a first insulative housing having two opposite first edges, two opposite second edges, and a socket hole defined in a top of the first insulative housing;

multiple first terminals mounted in the socket hole;

an outer casing mounted on the first insulative housing and having two opposite first sides and two opposite second sides; and a locking lever mounted pivotally through the first sides of the outer casing and through the first edges of the first insulative housing and having two locking pins;

a male connector engaged detachably with the female connector and having a second insulative housing mounted detachably in the socket hole of the first insulative housing and having two opposite first sidewalls, two opposite second sidewalls, and two locking recesses defined respectively in the first sidewalls and selectively engaged respectively with the locking pins of the locking lever; and multiple second terminals mounted in the second insulative housing and selectively and respectively contacting the first terminals; and wherein when the male connector is engaged with the female connector with the second insulative housing mounted in the socket hole of the first insulative housing, disengaging the locking pins respectively from the locking recesses makes the second insulative housing freely separable from the first insulative housing, and engaging the locking pins respectively with the locking recesses locks and prevents the second insulative housing from separating from the first insulative housing.

2. The quick lock connector assembly as claimed in claim 1, wherein the locking lever further has an operating section;

two positioning sections formed on and protruding respectively from two ends of the operating section and selectively pressing respectively against the first sides of the outer casing; and two pivot sections formed on and protruding respectively from the positioning sections and rotatably extending respectively through the first sides of the outer casing and respectively through the first edges of the first insulative housing;

the locking pins are formed on and protrude respectively from the pivot sections; and when the male connector is engaged with the female connector with the second insulative housing mounted in the socket hole of the first insulative housing, separating the positioning sections of the locking lever respectively from the first sides of the outer casing disengages the locking pins respectively from the locking recesses and makes the second insulative housing freely separable from the first insulative housing, and pressing the positioning sections respectively against the first sides of the outer casing engages the locking pins respectively with the locking recesses and makes the second insulative housing inseparable from the first insulative housing.

3. The quick lock connector assembly as claimed in claim 2, wherein the locking pins of the locking lever are located in the socket hole of the first insulative housing.

4. The quick lock connector assembly as claimed in claim 3, wherein the second insulative housing further has two through slots vertically defined through the second insulative housing and respectively in the first sidewalls, and each through slot has two opposite inner walls;

the locking recesses correspond to the through slots and each locking recess is defined in one of the inner walls of a corresponding through slot;

the locking pins are substantially perpendicular to the pivot sections;

when the locking pins pivot to be substantially parallel with the through slots, moving the second insulative housing vertically is capable of disengaging the locking pins respectively from the through slots; and when the second insulative housing is mounted in the socket hole of the first insulative housing, pivoting the locking pins to be substantially perpendicular to the through slots and engaged respectively with the locking recesses locks and prevents the second insulative housing from separating from the first insulative housing.

5. The quick lock connector assembly as claimed in claim 4, wherein each positioning section has a V-shaped and peak-like positioning element formed on the pivot section and selectively pressing against one of the first sides of the outer casing.

6. The quick lock connector assembly as claimed in claim 5, wherein the first insulative housing further has two assembling holes defined respectively in the first edges;

the outer casing further has two pivot holes defined respectively through the first sides of the outer casing; and the pivot sections of the locking lever rotatably extend respectively through the pivot holes of the outer casing and respectively through the assembling holes of the first insulative housing.

7. The quick lock connector assembly as claimed in claim 6, wherein the outer casing further has an opening defined through the outer casing and corresponding to the socket hole.

8. The quick lock connector assembly as claimed in claim 7, wherein the locking lever is made of metal.

9. The quick lock connector assembly as claimed in claim 8, wherein the outer casing is made of metal.

* * * * *